US011598162B2

(12) United States Patent
Wang et al.

(10) Patent No.: US 11,598,162 B2
(45) Date of Patent: Mar. 7, 2023

(54) HYDRAULIC ROTARY SIDE-SWING ELEVATOR

(71) Applicant: Huangshan Huaneng Petrochemical Machinery Co., Ltd., Huangshan (CN)

(72) Inventors: Kang Wang, Huangshan (CN); Yang Li, Huangshan (CN); Zulin Liu, Huangshan (CN); Kuan Tian, Huangshan (CN); Yingxiang Dong, Huangshan (CN); Xiaodong Zhang, Huangshan (CN)

(73) Assignee: HUANGSHAN HUANENG PETROCHEMICAL MACHINERY CO., LTD., Huangshan (CN)

( * ) Notice: Subject to any disclaimer, the term of this patent is extended or adjusted under 35 U.S.C. 154(b) by 0 days.

(21) Appl. No.: 17/516,741

(22) Filed: Nov. 2, 2021

(65) Prior Publication Data

US 2022/0136342 A1 May 5, 2022

(30) Foreign Application Priority Data

Nov. 3, 2020 (CN) ..... 202011206414.1

(51) Int. Cl.
*E21B 19/06* (2006.01)

(52) U.S. Cl.
CPC ..... *E21B 19/06* (2013.01)

(58) Field of Classification Search
CPC ..... E21B 19/06
See application file for complete search history.

(56) References Cited

U.S. PATENT DOCUMENTS 1,420,010 A * 6/1922 Wright ..... E21B 19/06 294/90
1,547,282 A * 7/1925 Youker ..... E21B 19/06 294/90
1,766,556 A * 6/1930 Smith ..... E21B 19/06 294/90
2,215,649 A * 9/1940 Mullinix ..... E21B 19/06 294/90
2,281,128 A * 4/1942 Webster ..... E21B 19/06 294/91
2,375,584 A * 5/1945 Mason ..... E21B 19/06 294/90

(Continued)

*Primary Examiner* — Aaron L Lembo
(74) *Attorney, Agent, or Firm* — Bayramoglu Law Offices LLC

(57) ABSTRACT

A hydraulic rotary side-swing elevator includes an elevator body, a side swing mechanism and a rotating mechanism. Rotatable shafts are arranged on left and right sides of the elevator body. An inner hinge and an outer hinge are respectively provided on the two rotatable shafts. An inner hinge driving structure includes an inner hinge opening and closing cylinder and an opening and closing cylinder fixing seat. An outer hinge driving structure includes an outer hinge locking cylinder and a locking cylinder fixing seat. The opening and closing cylinder fixing seat and the locking cylinder fixing seat are arranged on a rear side wall of the elevator body. A cylinder barrel part of the inner hinge opening and closing cylinder is hinged on the opening and closing cylinder fixing seat, and a piston part of the inner hinge opening and closing cylinder is hinged to the inner hinge.

13 Claims, 9 Drawing Sheets

(56) References Cited

U.S. PATENT DOCUMENTS

| | | | | | |
|---|---|---|---|---|---|
| 2,392,462 | A * | 1/1946 | Coe | E21B 19/06 | 294/90 |
| 2,957,724 | A * | 10/1960 | Bujold | E21B 19/06 | 294/102.2 |
| 3,494,484 | A * | 2/1970 | McFadden | E21B 19/155 | 294/90 |
| 3,884,519 | A * | 5/1975 | McFadden | E21B 19/06 | 294/90 |
| 4,035,012 | A * | 7/1977 | Guier | E21B 19/06 | 294/90 |
| 6,494,273 | B1 * | 12/2002 | Martin | E21B 19/06 | 175/220 |
| 9,790,750 | B1 * | 10/2017 | Stoldt | E21B 19/07 | |
| 2007/0062688 | A1 * | 3/2007 | Schats | E21B 19/06 | 166/85.1 |

* cited by examiner

HYDRAULIC ROTARY SIDE-SWING ELEVATOR

CROSS REFERENCE TO THE RELATED APPLICATIONS

This application is based upon and claims priority to Chinese Patent Application No. 202011206414.1, filed on Nov. 3, 2020, the entire contents of which are incorporated herein by reference.

TECHNICAL FIELD

The present disclosure relates to a hydraulic rotary side-swing elevator, in particular to a 150ST hydraulic rotary side-swing elevator.

BACKGROUND

Most of the mechanical elevators on the market are manually operated, which have high work intensity, low work efficiency and potential safety hazards. In addition, in oilfield drilling and workover sites, it is hard to observe the state of the elevator with the naked eyes when the elevator is at a high altitude, and thus the operator cannot well and truly know the state of the elevator.

SUMMARY

In order to solve the above-mentioned problems existing in the prior art, an objective of the present disclosure is to provide a hydraulic rotary side-swing elevator.

In order to solve the above-mentioned technical problem, the present disclosure adopts the following technical solution: a hydraulic rotary side-swing elevator. The elevator includes an elevator body, a side swing mechanism and a rotating mechanism, where a middle part of the elevator body is provided with a tubing hole that penetrates upper and lower end surfaces; the tubing hole is provided with a notch door on a front side of the elevator body; the elevator body is provided with an openable inner hinge at a position of the notch door; the elevator body is provided with an openable outer hinge outside the inner hinge; the outer hinge is used to enclose the inner hinge so as to lock the inner hinge; and the elevator body is further provided with an inner hinge driving structure for driving the inner hinge to be opened and closed and an outer hinge driving structure for driving the outer hinge to be opened and closed;

rotatable shafts are arranged on left and right sides of the elevator body; the inner hinge and the outer hinge are respectively provided on the two rotatable shafts; the inner hinge driving structure includes an inner hinge opening and closing cylinder and an opening and closing cylinder fixing seat; the outer hinge driving structure includes an outer hinge locking cylinder and a locking cylinder fixing seat; the opening and closing cylinder fixing seat and the locking cylinder fixing seat are arranged on a rear side wall of the elevator body; a cylinder barrel part of the inner hinge opening and closing cylinder is hinged on the opening and closing cylinder fixing seat, and a piston part of the inner hinge opening and closing cylinder is hinged to the inner hinge; and a cylinder barrel part of the outer hinge locking cylinder is hinged on the locking cylinder fixing seat, and a piston part of the outer hinge locking cylinder is hinged to the outer hinge;

the side swing mechanism includes an external fixed structure for external assembly and swing rods; the swing rods are arranged on left and right sides of the external fixed structure; the external fixed structure is provided with rotatable side swing cylinders; piston parts of the side swing cylinders are respectively hinged on the swing rods; and bottoms of the swing rods are respectively provided with a hanging ring connected to the elevator body; and the rotating mechanism includes a rotating box body and a rotation driving structure provided on the rotating box body; an upper part of the rotating box body is provided on the swing rod, and a lower part of the rotating box body is provided with a rotating head; and one end of the rotating head is rotatably connected to the rotation driving structure, and the other end thereof is connected to the elevator body.

Further, the left and right sides of the elevator body may be provided with cylinder track grooves that may be adapted to the inner hinge opening and closing cylinder and the outer hinge locking cylinder respectively; and front ends of the cylinder track grooves may be provided with rotatable shaft holes that may be adapted to the rotatable shafts respectively.

Further, the elevator may include a primary bushing provided in the tubing hole and a secondary bushing provided on an inner side wall of the inner hinge; the primary bushing and the secondary bushing define a tubular structure that may be coaxial with the tubing hole; an upper inner side wall of the tubing hole may be provided with a primary bushing assembly notch that may be adapted to the primary bushing; an upper inner side wall of the inner hinge may be provided with a secondary bushing assembly notch that may be adapted to the secondary bushing; a set of bushing positioning holes may be provided on an upper end surface of the elevator body and upper ends of the bushings; the primary bushing and the secondary bushing may be provided with bushing limiting pins adapted to the bushing positioning holes; and tops of the limiting pins may be respectively provided with a detachable hexagonal slotted nut.

Further, the elevator may include a tubing string sensing structure; the tubing string sensing structure may include a tubing string sensing proximity switch, a tubing string sensing block, a tubing string sensing pin and a tubing string sensing compression spring; the primary bushing may be provided with a tubing string sensing notch; the elevator body may be provided with a tubing string sensing track through hole that penetrates a side wall of the elevator body to communicate with the tubing hole; an outer side wall of the elevator body may be provided with a tubing string sensing fixing seat; the tubing string sensing proximity switch may be vertically provided on the tubing string sensing fixing seat; the tubing string sensing pin may be movable in left and right directions in the tubing string sensing track through hole; the tubing string sensing compression spring may be provided in the tubing string sensing track through hole; a left side end of the tubing string sensing compression spring may be connected to the tubing string sensing pin, and the other end thereof may be connected to a right inner side wall of the tubing string sensing track through hole; a tubing string sensing fixed shaft may be provided in the tubing string sensing notch; the tubing string sensing block may be rotatably provided on the tubing string sensing fixed shaft; left and right ends of the tubing string sensing pin extend out of the tubing string sensing track through hole; and a left end part of the tubing string sensing pin may be connected to a right lower side wall of the tubing string sensing block, and a right end part thereof may be located under the tubing string sensing proximity switch.

Further, the elevator may include a tubing string downward pressure sensing structure; the tubing string downward pressure sensing structure may include a tubing string coupling sensing pin, a tubing string downward pressure sensing proximity switch, a tubing string downward pressure sensing block, a tubing string downward pressure sensing pin and a tubing string downward pressure sensing compression spring; the primary bushing may be provided with a tubing string downward pressure sensing notch above the tubing string sensing notch; the elevator body may be provided with a tubing string downward pressure sensing track through hole that penetrates the side wall of the elevator body to communicate with the tubing hole; the outer side wall of the elevator body may be provided with a tubing string downward pressure sensing fixing seat; the tubing string downward pressure sensing proximity switch may be provided on the tubing string downward pressure sensing fixing seat; the tubing string downward pressure sensing pin may be movable in left and right directions in the tubing string downward pressure sensing track through hole; the tubing string downward pressure sensing compression spring may be provided in the tubing string downward pressure sensing track through hole; two ends of the tubing string downward pressure sensing compression spring may respectively abut against the tubing string downward pressure sensing pin and an inner wall of the tubing string downward pressure sensing track through hole; a tubing string downward pressure sensing fixed shaft may be provided in the tubing string downward pressure sensing notch; the tubing string downward pressure sensing block may be rotatably provided on the tubing string downward pressure sensing fixed shaft; left and right ends of the tubing string downward pressure sensing pin extend out of the tubing string downward pressure sensing track through hole; a left end part of the tubing string downward pressure sensing pin may be connected to a right lower side wall of the tubing string downward pressure sensing block, and a right end part thereof may be adapted to the tubing string downward pressure sensing proximity switch; an upper end of the primary bushing may be provided with a tubing string downward pressure sensing through hole that may be communicated with the tubing string downward pressure sensing notch; the tubing string coupling sensing pin may be able to be raised and lowered in the tubing string downward pressure sensing through hole; a top end of the tubing string coupling sensing pin extends out of the tubing string downward pressure sensing through hole and may be adapted to a tubing string; an upper end of the tubing string coupling sensing pin extends out of an upper end surface of the primary bushing from the tubing string downward pressure sensing through hole; and the bottom of the tubing string coupling sensing pin may be connected to an upper end surface of the tubing string downward pressure sensing block.

Further, the hydraulic rotary side-swing elevator includes a locking structure; the locking structure may include a locking pressure pin, a locking strut, a locking pin and a locking compression spring; the secondary bushing may be movable in up and down directions in the secondary bushing assembly notch; an upper end surface of the secondary bushing may be movable in up and down directions between the bushing limiting pin and an upper end surface of the elevator body; the inner hinge may be provided therein with a locking track passage under the secondary bushing notch; the locking track passage may be L-shaped, with two ends respectively communicated with a bottom end surface of the secondary bushing assembly notch and an outer side wall of the inner hinge; the locking pressure pin may be able to be raised and lowered in the locking track passage; the top of the locking pressure pin extends out of the bottom end surface of the secondary bushing assembly notch and may be connected to a bottom surface of the secondary bushing; the outer side wall of the inner hinge may be provided with a locking pin fixing seat; a strut pin may be provided in the locking track passage; a middle part of the locking strut may be rotatably provided on the strut pin; one end of the locking strut extends out of the locking track passage and may be hinged to the bottom of the locking pin, and the other end of the locking strut located in the locking track passage may be connected to a lower end of the locking pressure pin; the locking pin fixing seat may be provided with a locking pin guide hole adapted to the locking pin; the top of the locking pin may be provided in the locking pin guide hole; the locking compression spring may be sleeved on the locking pin; the top of the locking compression spring may abut against a lower end surface of the locking pin fixing seat; an inner side wall of the outer hinge may be provided with a locking hole that may be adapted to the locking pin; a side wall of the inner hinge may be provided with a bushing limiting hole; a bushing limiting shaft may be provided in the bushing limiting hole; a side wall of the secondary bushing may be provided with a bushing limiting opening; and the bushing limiting shaft may be located in the bushing limiting opening.

Further, the left and right sides of the elevator body may be respectively provided with an openable lifting lug; the hanging ring hangs in the lifting lug; the lifting lug may include an upper lug body, a lower lug body and a lug connecting rod, which may be provided on a side wall of the elevator body; and two ends of the lug connecting rod may be detachably assembled with the upper lug body and the lower lug body.

The external fixed structure may include a snap ring for external connection; the snap ring may have a U-shaped opening structure; an opening part of the snap ring may be provided with a transverse fixing seat; two ends of the transverse fixing seat may be connected to two ends of the opening part of the snap ring; a snap ring shaft may be provided on the transverse fixing seat; the snap ring shaft may be provided with a set of rotatable support rods; the ends of the support rods away from the snap ring shaft may be provided with a side swing shaft; two ends of the side swing shaft may be hinged to the side swing cylinders; the top of each of the swing rods may be provided with a hook for external connection; a middle part of each of the swing rods may be provided with a side swing fixing seat; a cylinder barrel part of each of the side swing cylinders may be hinged on the side swing fixing seat; a piston part of each of the side swing cylinders may be connected to the side swing shaft; and a set of shaft sleeves may be provided on the side swing shaft.

Further, the rotating mechanism may include a rotating box body; an upper part of the rotating box body may be provided with a clamping ring that may be adapted to the swing rod; the rotation driving structure may include a rotating cylinder provided in the rotating box body; the rotating cylinder may be provided vertically; a cylinder barrel part of the rotating cylinder may be provided in the rotating box body, and a piston part thereof may be hinged to a triangular connecting rod; the rotating box body may be provided with a connecting rod structure under the triangular connecting rod; a lower end of the connecting rod structure may be hinged to a rotating head; a top end of the connecting rod structure may be hinged to a right side end of the triangular connecting rod; the rotating box body may be provided with a connecting rod shaft that may be adapted to a left side end of the triangular connecting rod; the left side end of the triangular connecting rod may be hinged on the connecting rod shaft; the rotating box body 11 may be further provided with a rotating shaft; a middle part of the rotating head may be rotatable on the rotating shaft; the lifting lug may be provided with a rotating structure mounting plate; a left side of the rotating head may be provided with a rotating positioning slot adapted to the rotating structure mounting plate; the rotating positioning slot may be assembled on the rotating structure mounting plate by a bolt; the rotating box body may be provided with a rotating limiting shaft above the triangular connecting rod; an upper part of the rotating box body may be provided with a rotating cylinder fixed shaft; the rotating cylinder fixed shaft may be provided with a double-headed nut; and a cylinder barrel part of the rotating cylinder may be provided on the double-headed nut.

Further, a transition plate may be provided on a right side of the rotating box body; the transition plate may be provided with a set of tubing sockets; an openable sealed box body may be provided on a rear side of the elevator body; a bottom edge of the sealed box body may be connected to a rear side wall edge of the elevator body; a sequence valve may be further provided on the rear side wall of the elevator body; the rotating cylinder may be connected to the tubing sockets through a tubing; the sequence valve may be connected to the tubing sockets through the tubing; the inner hinge opening and closing cylinder and the outer hinge locking cylinder may be connected to the sequence valve through the tubing; left and right side walls of the rotating box body may be provided with handles; a front side of the rotating box body may be provided with an openable door; the door may be provided with a door locking pin that penetrates a rear side wall of the rotating box body; the door may be further provided with a door locking hole adapted to the door locking pin; and a top end of the door locking pin extending out of the door locking hole may be provided with a door locking nut.

The present disclosure has the following beneficial effects. The elevator body, the side swing mechanism and the rotating mechanism cooperate to realize the side swing and rotation of the elevator without manual operation, which solves the problems that most of the elevators on the market are manually operated, and have high work intensity, low work efficiency and potential safety hazards. The inner hinge opening and closing cylinder and the outer hinge locking cylinder drive the inner hinge and the outer hinge to move to realize the side opening of the elevator body. The simply configured locking structure realizes the locking of the inner hinge by the outer hinge, which is stable, reliable, and easy to implement. The tubing string sensing structure and the tubing string downward pressure sensing structure are introduced to sense whether there is a tubing string in the elevator body and whether the tubing string is pressed downward. This facilitates the observation of the working state of the elevator body, improves the function of the entire structure, reduces the difficulty of determining the working state of the elevator body, simplifies the work, and improves the safety of the operation.

DETAILED DESCRIPTION OF THE EMBODIMENTS

Figure 1:
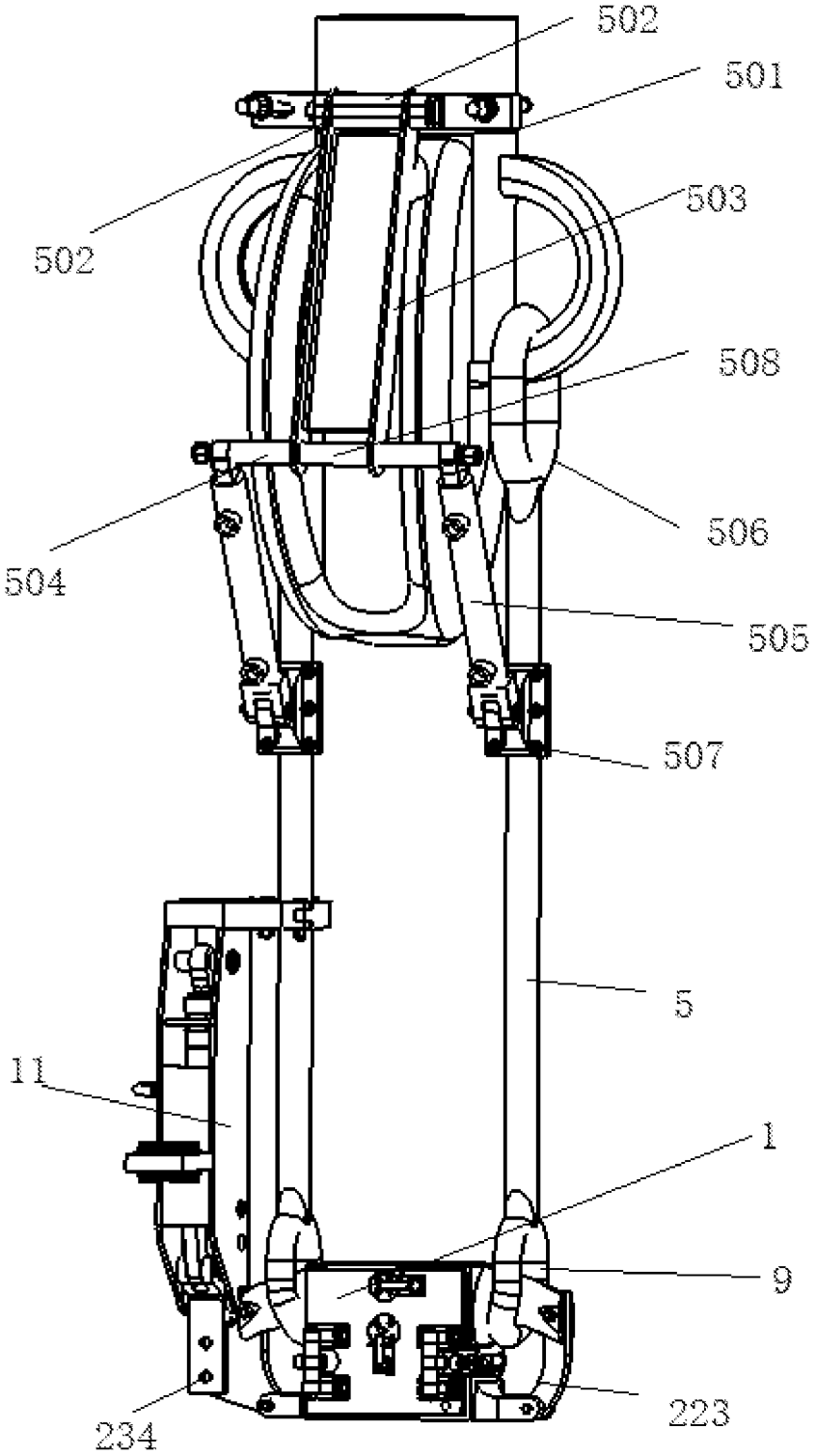
FIG. 1 is a view illustrating a structure according to the present disclosure.
Figure 2:
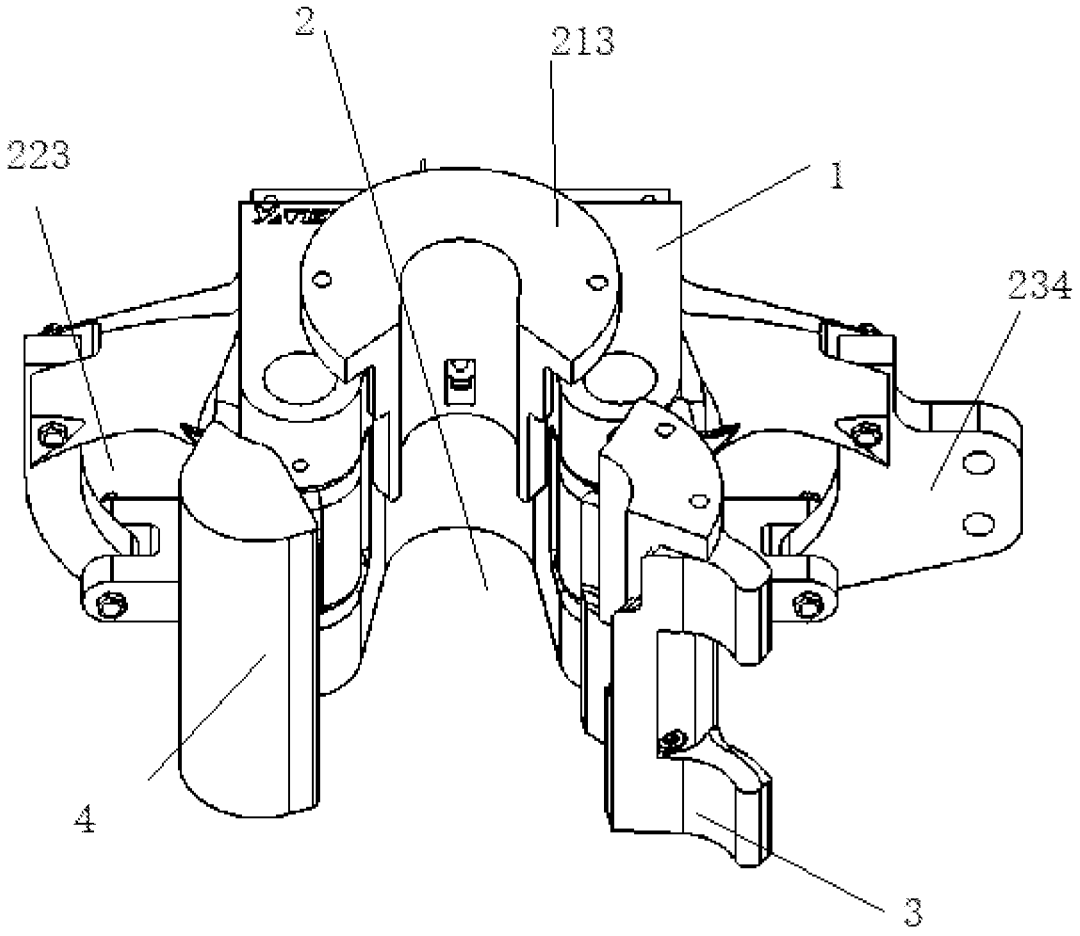
FIG. 2 is a view illustrating a structure of an elevator body when the elevator body is opened sideways.
Figure 3:
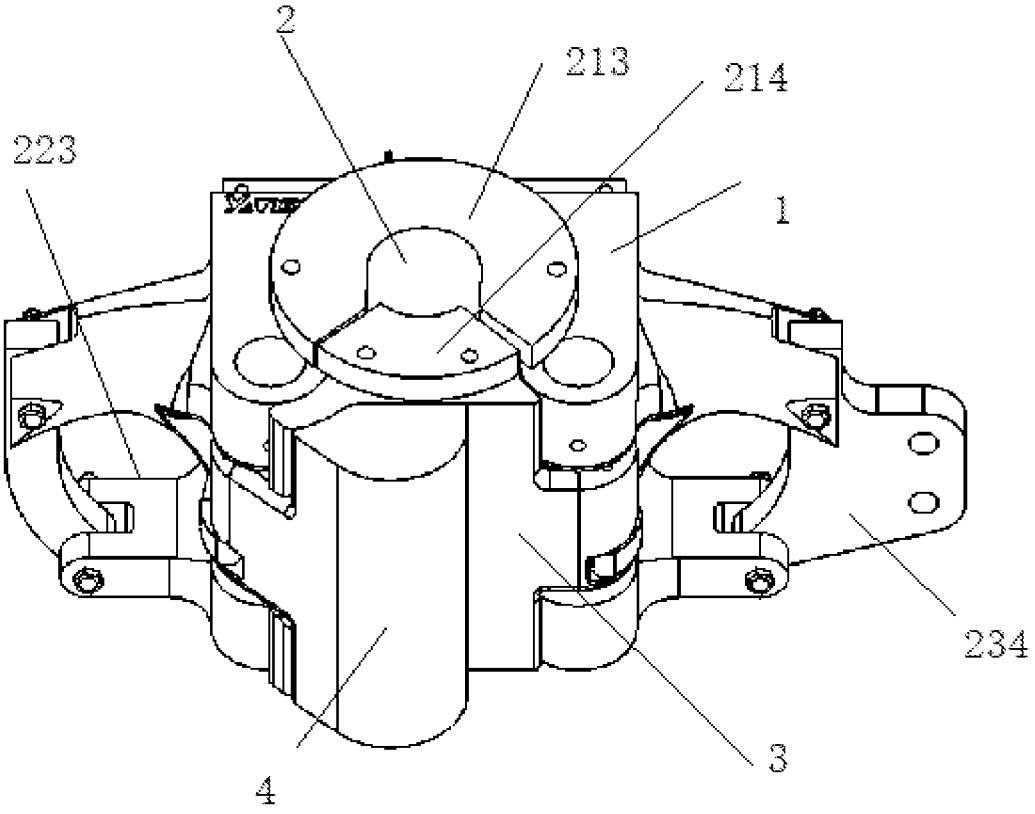
FIG. 3 is a view illustrating a structure of the elevator body when the elevator body is closed sideways.
Figure 4:
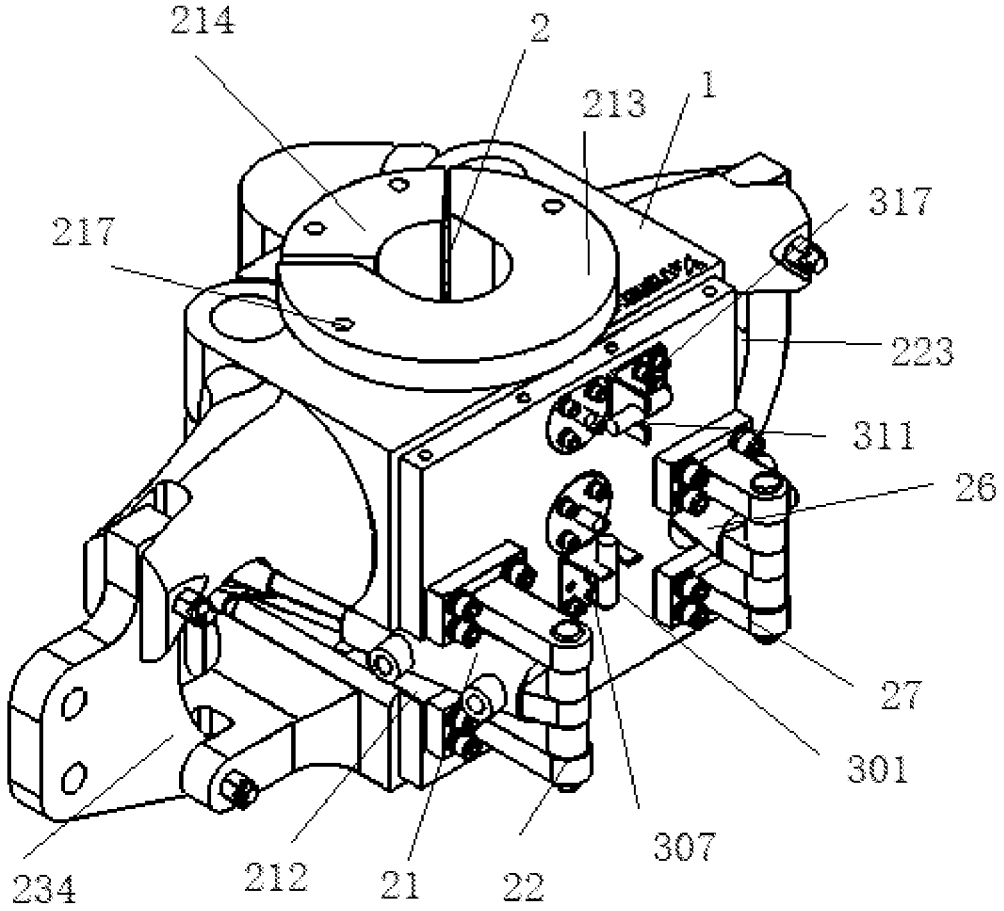
FIG. 4 is a back view of the elevator body.
Figure 5:
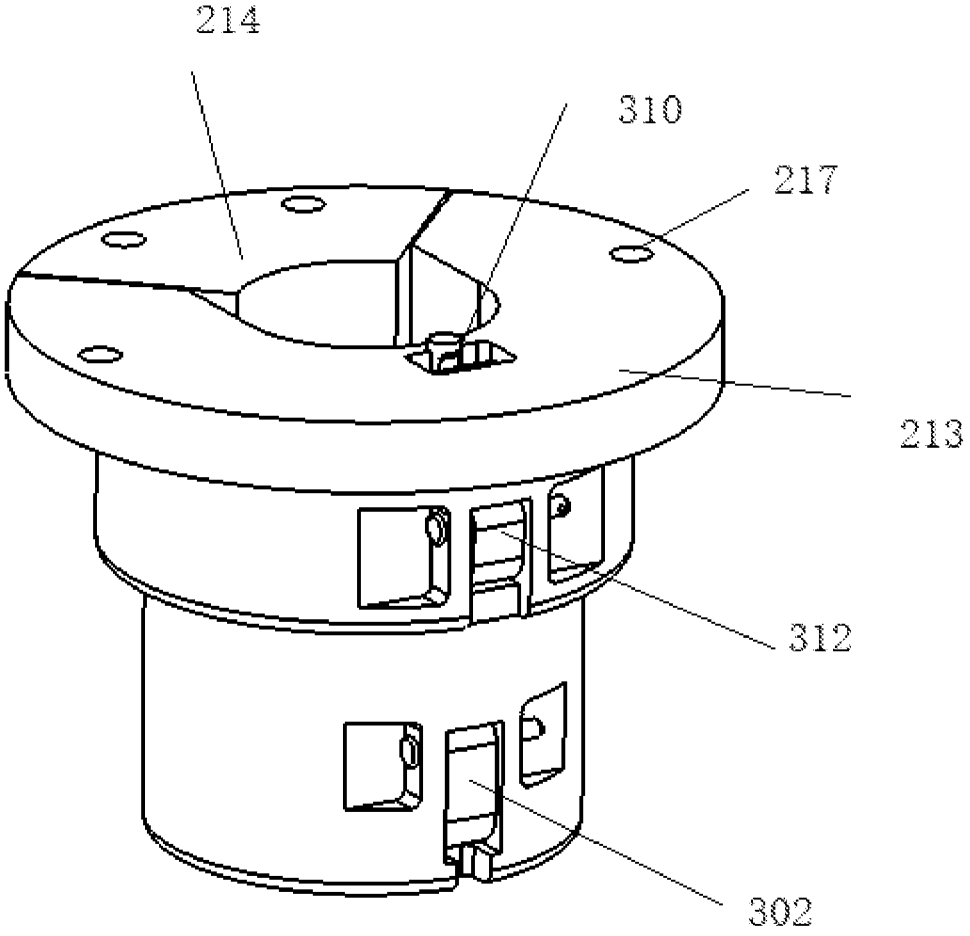
FIG. 5 is a view illustrating a primary bushing and a secondary bushing that cooperate.
Figure 6:
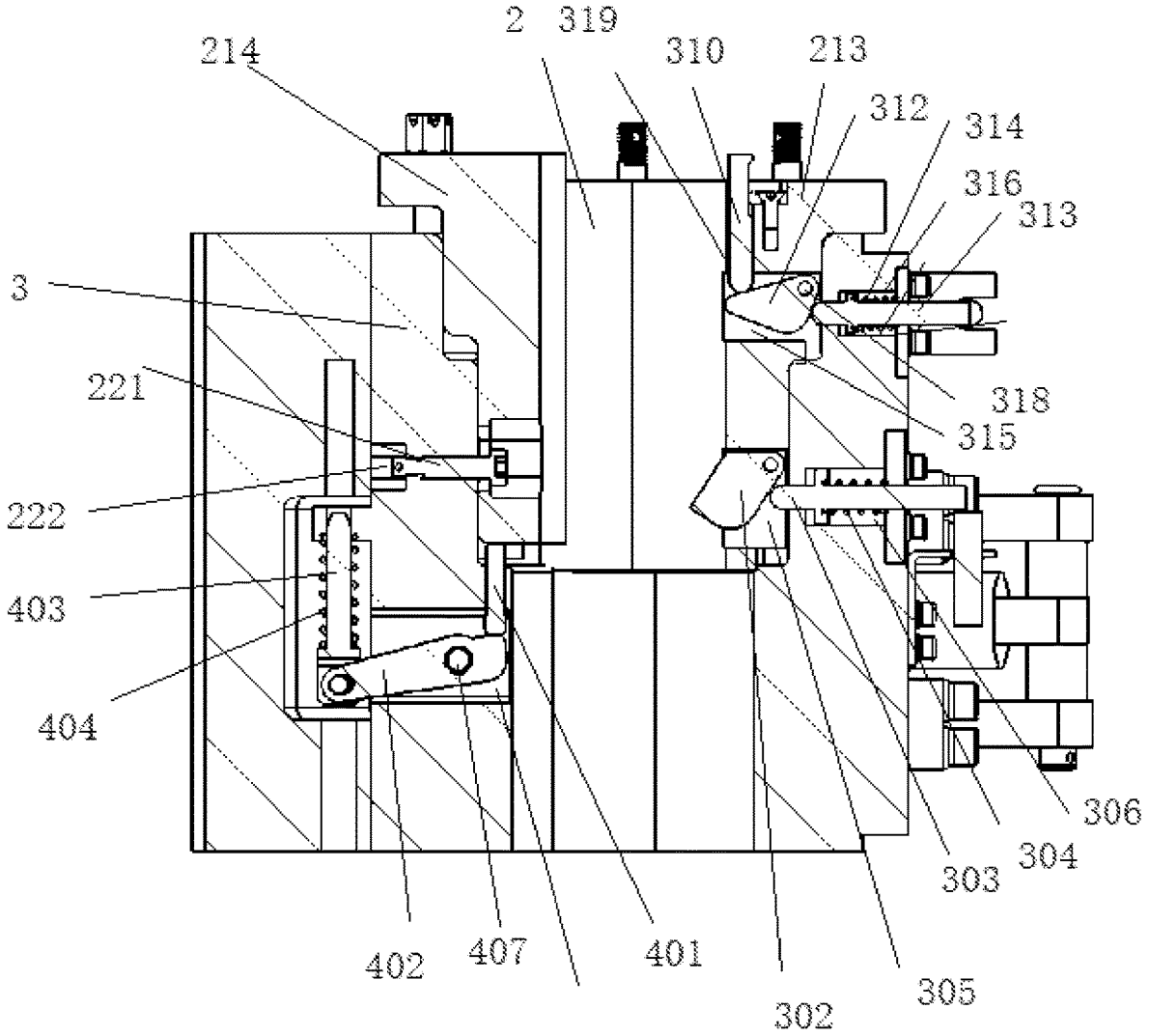
FIG. 6 is a sectional view of the elevator body.
Figure 7:
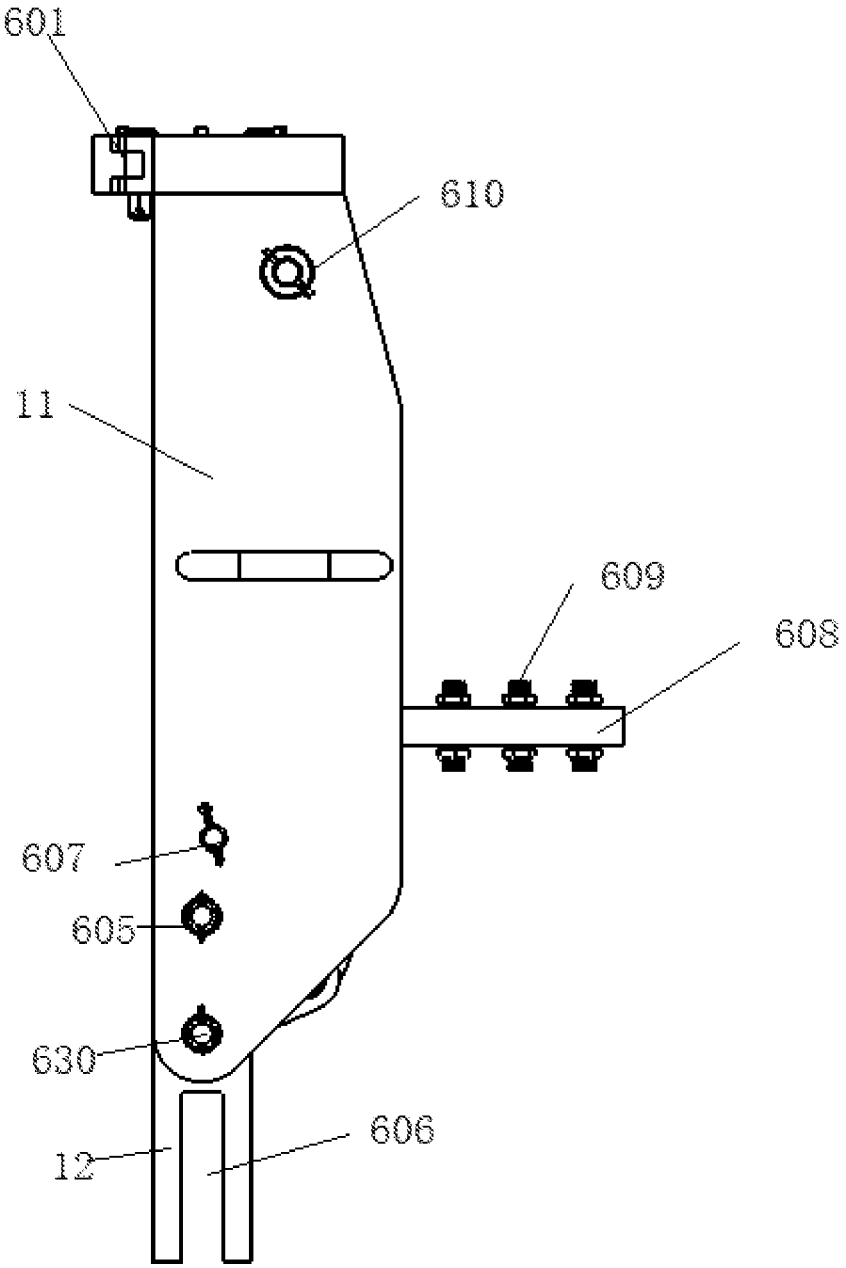
FIG. 7 is a view illustrating a structure of a rotating box body.
Figure 8:
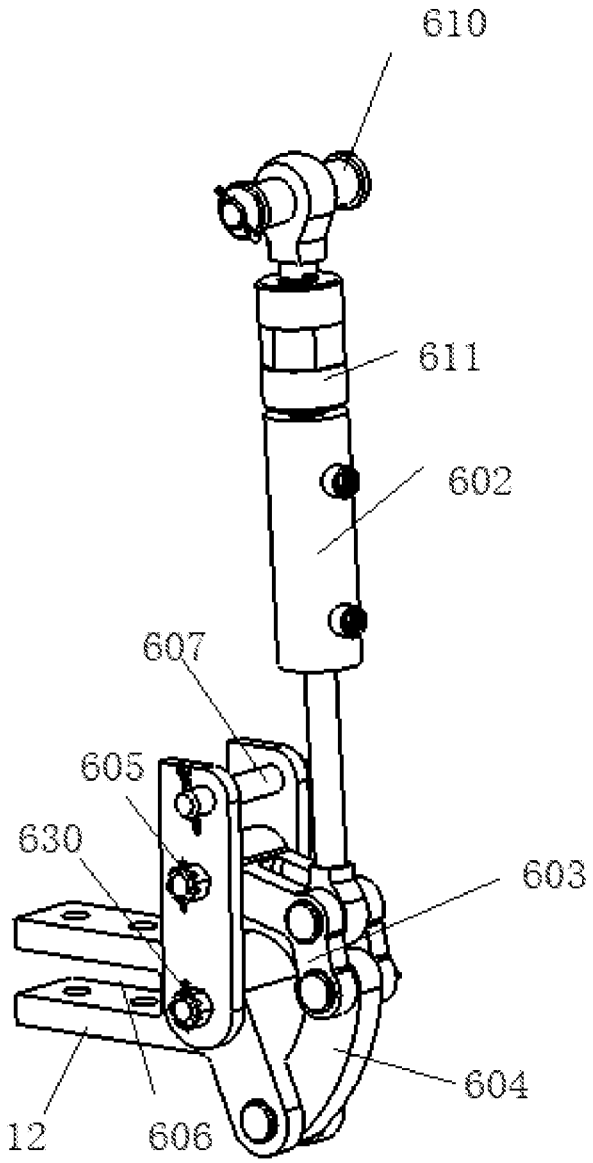
FIG. 8 is an internal view of a rotating structure.
Figure 9:
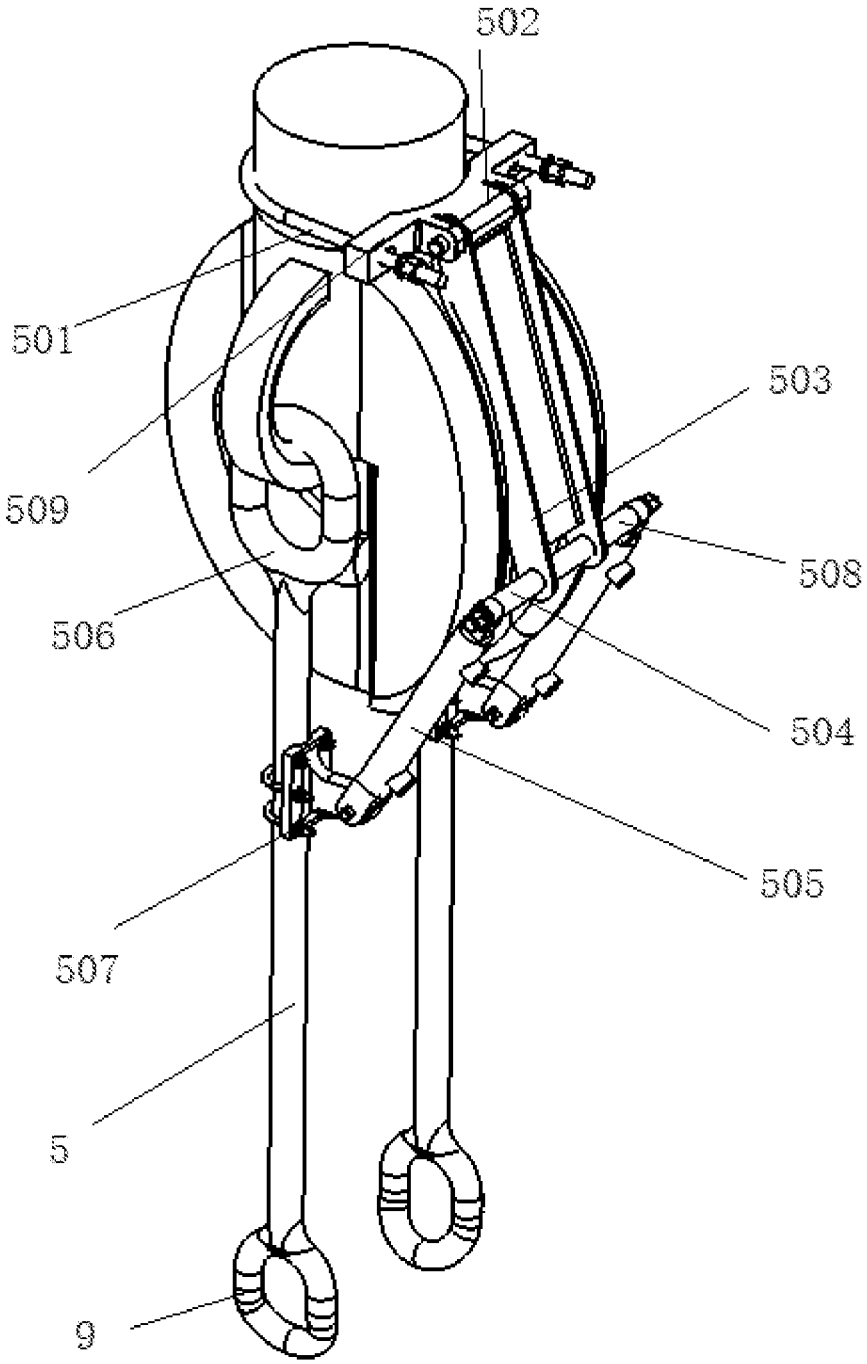
FIG. 9 is a view illustrating a structure of a side swing mechanism.

An embodiment of the present disclosure provides a hydraulic rotary side-swing elevator. As shown in FIGS. 1 to 9, the elevator includes an elevator body 1, a side swing mechanism and a rotating mechanism. A middle part of the elevator body 1 is provided with a tubing hole 2 that penetrates upper and lower end surfaces. The tubing hole 2 is provided with a notch door on a front side of the elevator body 1. The elevator body 1 is provided with an openable inner hinge 3 at a position of the notch door. The elevator body is provided with an openable outer hinge 4 outside the inner hinge 3. The outer hinge 4 is used to enclose the inner hinge 3 so as to lock the inner hinge 3. The elevator body is further provided with an inner hinge driving structure for driving the inner hinge to be opened and closed and an outer hinge driving structure for driving the outer hinge 4 to be opened and closed.

Rotatable shafts are arranged on left and right sides of the elevator body 1. The inner hinge 3 and the outer hinge 4 are respectively provided on the two rotatable shafts. The inner hinge driving structure includes an inner hinge opening and closing cylinder 21 and an opening and closing cylinder fixing seat 22. The outer hinge driving structure includes an outer hinge locking cylinder 26 and a locking cylinder fixing seat 27. The opening and closing cylinder fixing seat 22 and the locking cylinder fixing seat 27 are arranged on a rear side wall of the elevator body 1. A cylinder barrel part of the inner hinge opening and closing cylinder 21 is hinged on the opening and closing cylinder fixing seat 22, and a piston part of the inner hinge opening and closing cylinder 21 is hinged to the inner hinge 3. A cylinder barrel part of the outer hinge locking cylinder 26 is hinged on the locking cylinder fixing seat 27. A piston part of the outer hinge locking cylinder 26 is hinged to the outer hinge 4.

The side swing mechanism includes an external fixed structure for external assembly and swing rods 5. The swing rods 5 are arranged on left and right sides of the external fixed structure. The external fixed structure is provided with a fixed shaft 6. Left and right ends of the fixed shaft 6 are provided with rotatable side swing cylinders 7. The swing rods 5 are provided with clamping seats 8. Piston parts of the side swing cylinders 7 are respectively hinged on the clamping seats 8. Bottoms of the swing rods 5 are respectively provided with a hanging ring connected to the elevator body 1.

The rotating mechanism includes a rotating box body 11 and a rotation driving structure provided on the rotating box body 11. An upper part of the rotating box body 11 is provided on the swing rod 5, and a lower part of the rotating box body 11 is provided with a rotating head 12. One end of the rotating head 12 is rotatably connected to the rotation driving structure, and the other end thereof is connected to the elevator body 1. The rotating mechanism drives the elevator body 1 to rotate, and the side swing mechanism drives the rotating mechanism to swing sideways, thereby driving the elevator body 1 to swing sideways. The rotation and side swing of the elevator body 1 are realized without manual operations.

It should be understood that in the description of the present disclosure, terms such as "central", "transverse", "upper", "lower", "left", "right" "vertical", "horizontal", "top", "bottom", "inside" and "outside" indicate the orientation or position relationships based on the drawings. They are merely intended to facilitate and simplify the description of the present disclosure, rather than to indicate or imply that the mentioned device or components must have a specific orientation or must be constructed and operated in a specific orientation. Therefore, these terms should not be construed as a limitation to the present disclosure. Moreover, the terms such as "first" and "second" are used only for the purpose of description and should not be construed as indicating or implying relative importance, or implicitly indicating a quantity of indicated technical features. Thus, features defined with "first" and "second" may explicitly or implicitly include one or more of the features. In the description of the present disclosure, unless otherwise specified, "a plurality of" means at least two. In addition, the term "include" and any variations thereof are intended to cover non-exclusive inclusion.

In the description of the present disclosure, it should be noted that, unless otherwise clearly specified, meanings of terms "install", "connected with", and "connected to" should be understood in a board sense. For example, the connection may be a fixed connection, a removable connection, or an integral connection; may be a mechanical connection or an electrical connection; may be a direct connection or an indirect connection by using an intermediate medium; or may be intercommunication between two components. Those of ordinary skill in the art may understand the specific meanings of the above terms in the present disclosure based on the specific situation.

The terms used herein are merely intended to describe the specific embodiments of the present disclosure, rather than to limit the exemplary embodiments of the present disclosure. Unless expressly stated otherwise, the singular forms "a" and "an" used herein may also include plural forms. It should also be understood that the terms "include" and/or "comprise" used herein indicate the existence of stated features, integers, steps, operations, units and/or components without excluding the possibility of existence or addition of one or more other features, integers, steps, operations, units, components, and/or combinations thereof.

The concept of the present disclosure is described in more detail with reference to the drawings.

A hydraulic rotary side-swing elevator includes an elevator body 1, a side swing mechanism and a rotating mechanism. A middle part of the elevator body 1 is provided with a tubing hole 2 that penetrates upper and lower end surfaces. The tubing hole 2 is provided with a notch door on a front side of the elevator body 1. The elevator body 1 is provided with an openable inner hinge 3 at a position of the notch door. The elevator body is provided with an openable outer hinge 4 outside the inner hinge 3. The outer hinge 4 is used to enclose the inner hinge 3 so as to lock the inner hinge 3. The elevator body is further provided with an inner hinge driving structure for driving the inner hinge to be opened and closed and an outer hinge driving structure for driving the outer hinge 4 to be opened and closed.

Rotatable shafts are arranged on left and right sides of the elevator body 1. The inner hinge 3 and the outer hinge 4 are respectively provided on the two rotatable shafts. The inner hinge driving structure includes an inner hinge opening and closing cylinder 21 and an opening and closing cylinder fixing seat 22. The outer hinge driving structure includes an outer hinge locking cylinder 26 and a locking cylinder fixing seat 27. The opening and closing cylinder fixing seat 22 and the locking cylinder fixing seat 27 are arranged on a rear side wall of the elevator body 1. A cylinder barrel part of the inner hinge opening and closing cylinder 21 is hinged on the opening and closing cylinder fixing seat 22, and a piston part of the inner hinge opening and closing cylinder 21 is hinged to the inner hinge 3. A cylinder barrel part of the outer hinge locking cylinder 26 is hinged on the locking cylinder fixing seat 27. A piston part of the outer hinge locking cylinder 26 is hinged to the outer hinge 4.

The side swing mechanism includes an external fixed structure for external assembly and swing rods 5. The swing rods 5 are arranged on left and right sides of the external fixed structure. The external fixed structure is provided with rotatable side swing cylinders 505. Piston parts of the side swing cylinders 505 are respectively hinged on the swing rods 5. Bottoms of the swing rods 5 are respectively provided with a hanging ring connected to the elevator body 1.

The rotating mechanism includes a rotating box body 11 and a rotation driving structure provided on the rotating box body 11. An upper part of the rotating box body 11 is provided on the swing rod 5, and a lower part of the rotating box body 11 is provided with a rotating head 12. One end of the rotating head 12 is rotatably connected to the rotation driving structure, and the other end thereof is connected to the elevator body 1. The rotating mechanism drives the elevator body 1 to rotate, and the side swing mechanism drives the rotating mechanism to swing sideways, thereby driving the elevator body 1 to swing sideways. The rotation and side swing of the elevator body 1 are realized without manual operations.

The left and right sides of the elevator body 1 are provided with cylinder track grooves 212 that are adapted to the inner hinge opening and closing cylinder 21 and the outer hinge locking cylinder 26 respectively. Front ends of the cylinder track grooves 212 are provided with rotatable shaft holes that are adapted to the rotatable shafts respectively.

The inner hinge opening and closing cylinder 21 drives the inner hinge 3 to move, and the outer hinge locking cylinder 26 drives the outer hinge 4 to move, thereby realizing the side opening and side closing of the elevator body.

The hydraulic rotary side-swing elevator further includes a primary bushing 213 provided in the tubing hole 2 and a secondary bushing 214 provided on an inner side wall of the inner hinge 3. The primary bushing 213 and the secondary bushing 214 define a tubular structure that is coaxial with the tubing hole 2. An upper inner side wall of the tubing hole 2 is provided with a primary bushing assembly notch that is adapted to the primary bushing 213. An upper inner side wall of the inner hinge 3 is provided with a secondary bushing assembly notch that is adapted to the secondary bushing 214. A set of bushing positioning holes 217 are provided on an upper end surface of the elevator body 1 and upper ends of the primary bushing 213 and the secondary bushing 214. The primary bushing 213 and the secondary bushing 214 are provided with bushing limiting pins adapted to the bushing positioning holes 217. Tops of the limiting pins are respectively provided with a detachable hexagonal slotted nut. In this way, the primary bushing 213 and the secondary bushing 214 are detachable, and the primary bushing 213 and the secondary bushing 214 can be replaced according to the needs for different tubing diameters.

The hydraulic rotary side-swing elevator further includes a tubing string sensing structure. The tubing string sensing structure includes a tubing string sensing proximity switch 301, a tubing string sensing block 302, a tubing string sensing pin 303 and a tubing string sensing compression spring 304. The primary bushing 213 is provided with a tubing string sensing notch 305. The elevator body 1 is provided with a tubing string sensing track through hole 306 that penetrates a side wall of the elevator body to communicate with the tubing hole 2. An outer side wall of the elevator body 1 is provided with a tubing string sensing fixing seat 307. The tubing string sensing proximity switch 301 is vertically provided on the tubing string sensing fixing seat 307. The tubing string sensing pin 303 is movable in left and right directions in the tubing string sensing track through hole 306. The tubing string sensing compression spring 304 is provided in the tubing string sensing track through hole 306. A left side end of the tubing string sensing compression spring is connected to the tubing string sensing pin 303, and the other end thereof is connected to a right inner side wall of the tubing string sensing track through hole 306. A tubing string sensing fixed shaft 6 is provided in the tubing string sensing notch 305. The tubing string sensing block 302 is rotatably provided on the tubing string sensing fixed shaft 6. Left and right ends of the tubing string sensing pin 303 extend out of the tubing string sensing track through hole 306. A left end part of the tubing string sensing pin is connected to a right lower side wall of the tubing string sensing block 302, and a right end part thereof is located under the tubing string sensing proximity switch 301.

The tubing string sensing structure is used to sense whether there is a tubing string in the elevator body 1. When there is a tubing string in the tubing hole 2, the tubing string exerts a force on the tubing string sensing block 302 and pushes the tubing string sensing block 302 to move downward until it is completely located in the tubing string sensing notch 305. Meanwhile, the tubing string sensing block 305 pushes the tubing string sensing pin 303 connected thereto back until its outer end part is located under the tubing string sensing proximity switch 301. After the tubing string sensing proximity switch 301 senses the tubing string sensing pin 303, it determines that there is a tubing in the tubing hole 2 and sends a signal to a relevant control system. When there is no tubing in the tubing hole 2, the tubing string sensing compression spring 304 drives the tubing string sensing pin 303 to return, thereby driving the tubing string sensing block 302 to return to an initial position. The tubing string sensing proximity switch 301 does not sense the tubing string sensing pin 303, so it sends a signal to the relevant control system that there is no tubing string in the elevator body 1.

The hydraulic rotary side-swing elevator further includes a tubing string downward pressure sensing structure. The tubing string downward pressure sensing structure includes a tubing string coupling sensing pin 310, a tubing string downward pressure sensing proximity switch 311, a tubing string downward pressure sensing block 312, a tubing string downward pressure sensing pin 313 and a tubing string downward pressure sensing compression spring 314. The primary bushing 213 is provided with a tubing string downward pressure sensing notch 315 above the tubing string sensing notch. The elevator body 1 is provided with a tubing string downward pressure sensing track through hole 316 that penetrates the side wall of the elevator body to communicate with the tubing hole 2. The outer side wall of the elevator body 1 is provided with a tubing string downward pressure sensing fixing seat 317. The tubing string downward pressure sensing proximity switch 311 is provided on the tubing string downward pressure sensing fixing seat 317. The tubing string downward pressure sensing pin 313 is movable in left and right directions in the tubing string downward pressure sensing track through hole 316. The tubing string downward pressure sensing compression spring 314 is provided in the tubing string downward pressure sensing track through hole 316. Two ends of the tubing string downward pressure sensing compression spring respectively abut against the tubing string downward pressure sensing pin 313 and an inner wall of the tubing string downward pressure sensing track through hole 316. A tubing string downward pressure sensing fixed shaft 318 is provided in the tubing string downward pressure sensing notch 315. The tubing string downward pressure sensing block 312 is rotatably provided on the tubing string downward pressure sensing fixed shaft 318. Left and right ends of the tubing string downward pressure sensing pin 313 extend out of the tubing string downward pressure sensing track through hole 316. A left end part of the tubing string downward pressure sensing pin is connected to a right lower side wall of the tubing string downward pressure sensing block 312, and a right end part thereof is adapted to the tubing string downward pressure sensing proximity switch 311. An upper end of the primary bushing 213 is provided with a tubing string downward pressure sensing through hole 319 that is communicated with the tubing string downward pressure sensing notch 315. The tubing string coupling sensing pin 310 is able to be raised and lowered in the tubing string downward pressure sensing through hole 319. A top end of the tubing string coupling sensing pin extends out of the tubing string downward pressure sensing through hole 319 and is adapted to a tubing string. An upper end of the tubing string coupling sensing pin 310 extends out of an upper end surface of the primary bushing 213 from the tubing string downward pressure sensing through hole 319. The bottom of the tubing string coupling sensing pin 310 is connected to an upper end surface of the tubing string downward pressure sensing block 312.

The tubing string downward pressure sensing structure is used to sense whether a tubing string is pressed downward in the elevator body, so as to further determine the working state of the elevator body. When a tubing string is pressed downward, the tubing string exerts a downward force on the tubing string coupling sensing pin 310. The tubing string coupling sensing pin 310 is lowered, forcing the tubing string downward pressure sensing block 312 connected thereto to move. The movement of the tubing string downward pressure sensing block 312 drives the tubing string downward pressure sensing pin 313 to move backward to a sensing area of the tubing string downward pressure sensing proximity switch 311. The tubing string downward pressure sensing proximity switch 311 acquires a tubing string downward pressure signal and sends the signal to the relevant control system. When no tubing string is pressed downward, a resilience force of the tubing string downward pressure sensing compression spring 314 drives the tubing string downward pressure sensing pin 313, the tubing string downward pressure sensing block 312 and the tubing string coupling sensing pin 310 to return to their initial positions.

The tubing string downward pressure sensing structure cooperates with the tubing string sensing structure to determine whether there is a tubing string in the elevator body 1, whether the tubing string is pressed down and what state the tubing string is in the elevator body, so as to comprehensively determine the state of the tubing string in the elevator body 1.

The hydraulic rotary side-swing elevator further includes a locking structure. The locking structure includes a locking pressure pin 401, a locking strut 402, a locking pin 403 and a locking compression spring 404. The secondary bushing 214 is movable in up and down directions in the secondary bushing assembly notch. The inner hinge 3 is provided therein with a locking track passage 405 under the secondary bushing notch. The locking track passage 405 is L-shaped, with two ends respectively communicated with a bottom end surface of the secondary bushing assembly notch and an outer side wall of the inner hinge 3. The locking pressure pin 401 is able to be raised and lowered in the locking track passage 405. The top of the locking pressure pin extends out of the bottom end surface of the secondary bushing assembly notch and is connected to a bottom surface of the secondary bushing 214. The outer side wall of the inner hinge 3 is provided with a locking pin fixing seat. A strut pin 407 is provided in the locking track passage 405. A middle part of the locking strut 402 is rotatably provided on the strut pin 407. One end of the locking strut 402 extends out of the locking track passage 405 and is hinged to the bottom of the locking pin 403, and the other end of the locking strut 402 located in the locking track passage 405 is connected to a lower end of the locking pressure pin 401. The locking pin fixing seat is provided with a locking pin guide hole 408 adapted to the locking pin 403. The top of the locking pin 403 is provided in the locking pin guide hole 408. The locking compression spring 404 is sleeved on the locking pin 403. The top of the locking compression spring abuts against a lower end surface of the locking pin fixing seat. An inner side wall of the outer hinge 4 is provided with a locking hole that is adapted to the locking pin 403.

A side wall of the inner hinge 3 is provided with a bushing limiting hole 220. A bushing limiting shaft 221 is provided in the bushing limiting hole 220. A side wall of the secondary bushing 214 is provided with a bushing limiting opening 222. The bushing limiting shaft 221 is located in the bushing limiting opening 222.

When the inner hinge 3 runs to the notch door to close the tubing hole 2 sideways, the outer hinge 4 runs to the outside of the inner hinge 3. When the inner hinge needs to be locked, the tubing string exerts a downward pressure on a position where the upper end surface of the secondary bushing 214 is connected, so as to drive the secondary bushing 214 to press downward. The bottom of the secondary bushing 214 exerts a downward pressure on the locking pressure pin 401, pushing the locking pressure pin 401 to move downward. The locking pressure pin 401 exerts a force on the locking strut 402, such that the locking strut 402 rotates to drive the locking pin 403 connected to the other end of the locking strut to rise. When the top end of the locking pin 403 moves into a locking pin hole, the outer hinge 4 locks the inner hinge 3. When there is no tubing string and no locking is required, the secondary bushing 214 does not apply a force to the locking pressure pin 401. Under the action of the resilience force of the locking compression spring 404, the locking pin, the locking strut and the locking pressure pin are respectively returned to their initial positions. When the secondary bushing 214 is raised and lowered, the bushing limiting shaft 221 limits the stroke of the secondary bushing 214.

The left and right sides of the elevator body 1 are respectively provided with an openable lifting lug 223. The hanging ring 9 hangs in the lifting lug 223. The lifting lug 223 includes an upper lug body, a lower lug body and a lug connecting rod, which are provided on a side wall of the elevator body 1. Two ends of the lug connecting rod are detachably assembled with the upper lug body and the lower lug body.

The external fixed structure includes a snap ring 501 for external connection. The snap ring 501 has a U-shaped opening structure. An opening part of the snap ring is provided with a transverse fixing seat 509. Two ends of the transverse fixing seat 509 are connected to two ends of the opening part of the snap ring 501. A snap ring shaft 502 is provided on the transverse fixing seat 509. The snap ring shaft 502 is provided with a set of rotatable support rods 503. The ends of the support rods 503 away from the snap ring shaft 502 are provided with a side swing shaft 504. Two ends of the side swing shaft 504 are hinged to the side swing cylinders 505. The top of each of the swing rods 5 is provided with a hook 506 for external connection. A middle part of each of the swing rods 5 is provided with a side swing fixing seat 507. A cylinder barrel part of each of the side swing cylinders 505 is hinged on the side swing fixing seat 507. A piston part of each of the side swing cylinders 505 is connected to the side swing shaft 504. A set of shaft sleeves 508 are provided on the side swing shaft 504.

The rotating mechanism includes a rotating box body 11. An upper part of the rotating box body 11 is provided with a clamping ring 601 that is adapted to the swing rod 5. The rotation driving structure includes a rotating cylinder 602 provided in the rotating box body 11. The rotating cylinder 602 is provided vertically. A cylinder barrel part of the rotating cylinder is provided in the rotating box body 11, and a piston part thereof is hinged to a triangular connecting rod 603. The rotating box body 11 is provided with a connecting rod structure 604 under the triangular connecting rod 603. A lower end of the connecting rod structure 604 is hinged to a rotating head 12. A top end of the connecting rod structure 604 is hinged to a right side end of the triangular connecting rod 603. The rotating box body 11 is provided with a connecting rod shaft 605 that is adapted to a left side end of the triangular connecting rod. The left side end of the triangular connecting rod is hinged on the connecting rod shaft 605. The rotating box body 11 is further provided with a rotating shaft 630. A middle part of the rotating head 12 is rotatable on the rotating shaft 630. The lifting lug 223 is provided with a rotating structure mounting plate 234. A left side of the rotating head 12 is provided with a rotating positioning slot 606 adapted to the rotating structure mounting plate 234. The rotating positioning slot 606 is assembled on the rotating structure mounting plate 234 by a bolt. The rotating box body 11 is provided with a rotating limiting shaft 607 above the triangular connecting rod 603. An upper part of the rotating box body 11 is provided with a rotating cylinder fixed shaft 610. The rotating cylinder fixed shaft 610 is provided with a double-headed nut 611. A cylinder barrel part of the rotating cylinder 602 is provided on the double-headed nut 611.

The left side end of the triangular connecting rod 603 rotates around the connecting rod shaft 605, and the right side end of the triangular connecting rod 603 is a movable end, which can move up and down. The connecting rod structure is fixed between the triangular connecting rod 603 and the rotating head 12, and is used to transmit a force from the triangular connecting rod 603 to the rotating head 12, thereby driving the rotating head 12 to rotate. The rotating head 12 is rotated around the rotating shaft 630.

During the rotation process, the piston part of the rotating cylinder 602 drives the triangular connecting rod 603 to move. The right side end of the triangular connecting rod 603 moves up and down, thereby driving the connecting rod structure 604 to move up and down. The movement of the connecting rod structure 604 brings a movement force to the rotating head 12, and drives the right side end of the rotating head to be lifted up and pressed down, making the rotating head rotate around the rotating shaft 630. The rotating limiting shaft 607 functions to limit the movement stroke of the rotating head.

A transition plate 608 is provided on a right side of the rotating box body 11. The transition plate 608 is provided with a set of tubing sockets 609. An openable sealed box body is provided on a rear side of the elevator body 1. A bottom edge of the sealed box body is connected to the rear side wall edge of the elevator body 1. A sequence valve is further provided on a rear side wall of the elevator body 1. The rotating cylinder 602 is connected to the tubing sockets 609 through a tubing. The sequence valve is connected to the tubing sockets 609 through the tubing. The inner hinge opening and closing cylinder 21 and the outer hinge locking cylinder 26 are connected to the sequence valve through the tubing. Left and right side walls of the rotating box body 11 are provided with handles 610. A front side of the rotating box body 11 is provided with an openable door. The door is provided with a door locking pin that penetrates a rear side wall of the rotating box body 11. The door is further provided with a door locking hole adapted to the door locking pin. A top end of the door locking pin extending out of the door locking hole is provided with a door locking nut. The sequence valve and the transition plate 608 make the tubing neat and improve the rationality of the structure.

The above embodiments are not considered from a limiting point of view, but from an illustrative point of view. The scope of the present disclosure is determined by the scope of the claims rather than the description, and it should be interpreted that all differences within an equivalent scope are included in the present disclosure. All insubstantial improvements made by adopting the concept and technical solution of the present disclosure or direct applications of the concept and technical solution of the present disclosure to other occasions without improvement fall within the protection scope of the present disclosure.

What is claimed is:

1. A hydraulic rotary side-swing elevator, comprising an elevator body, a side swing mechanism and a rotating mechanism, wherein a middle part of the elevator body is provided with a tubing hole, and the tubing hole penetrates upper and lower end surfaces; the tubing hole is provided with a notch door on a front side of the elevator body; the elevator body is provided with an inner hinge at a position of the notch door; the elevator body is provided with an outer hinge outside the inner hinge; the inner hinge and the outer hinge are openable; the outer hinge is used to enclose the inner hinge to lock the inner hinge; and the elevator body is further provided with an inner hinge driving structure for driving the inner hinge to be opened and closed and an outer hinge driving structure for driving the outer hinge to be opened and closed;

two rotatable shafts are arranged on left and right sides of the elevator body, respectively; the inner hinge and the outer hinge are respectively provided on the two rotatable shafts; the inner hinge driving structure comprises an inner hinge opening and closing cylinder and an opening and closing cylinder fixing seat; the outer hinge driving structure comprises an outer hinge locking cylinder and a locking cylinder fixing seat; the opening and closing cylinder fixing seat and the locking cylinder fixing seat are arranged on a rear side wall of the elevator body; a cylinder barrel part of the inner hinge opening and closing cylinder is hinged on the opening and closing cylinder fixing seat, and a piston part of the inner hinge opening and closing cylinder is hinged to the inner hinge; and a cylinder barrel part of the outer hinge locking cylinder is hinged on the locking cylinder fixing seat, and a piston part of the outer hinge locking cylinder is hinged to the outer hinge; and the rotating mechanism is connected to the elevator body to drive the elevator body to rotate; and the side swing mechanism is connected to the elevator body to drive the elevator body to swing sideways.

2. The hydraulic rotary side-swing elevator according to claim 1, wherein the side swing mechanism comprises an external fixed structure for external assembly and swing rods; the swing rods are arranged on left and right sides of the external fixed structure; the external fixed structure is provided with rotatable side swing cylinders; piston parts of the side swing cylinders are respectively hinged on the swing rods; and bottoms of the swing rods are respectively provided with a hanging ring connected to the elevator body;

the rotating mechanism comprises a rotating box body and a rotation driving structure provided on the rotating box body; an upper part of the rotating box body is provided on the swing rod, and a lower part of the rotating box body is provided with a rotating head; and a first end of the rotating head is rotatably connected to the rotation driving structure, and a second end of the rotating head is connected to the elevator body; and the left and right sides of the elevator body are provided with cylinder track grooves, and the cylinder track grooves are adapted to the inner hinge opening and closing cylinder and the outer hinge locking cylinder respectively; and front ends of the cylinder track grooves are provided with rotatable shaft holes, and the rotatable shaft holes are adapted to the rotatable shafts, respectively.

3. The hydraulic rotary side-swing elevator according to claim 2, wherein the left and right sides of the elevator body are respectively provided with an openable lifting lug; the hanging ring hangs in the openable lifting lug; the openable lifting lug comprises an upper lug body, a lower lug body and a lug connecting rod, wherein the upper lug body, the lower lug body and the lug connecting rod are provided on a side wall of the elevator body; and two ends of the lug connecting rod are detachably assembled with the upper lug body and the lower lug body.

4. The hydraulic rotary side-swing elevator according to claim 3, wherein the rotating mechanism comprises a rotating box body; an upper part of the rotating box body is provided with a clamping ring, and the clamping ring is adapted to the swing rod; the rotation driving structure comprises a rotating cylinder provided in the rotating box body; the rotating cylinder is provided vertically; a cylinder barrel part of the rotating cylinder is provided in the rotating box body, and a piston part of the rotating cylinder is hinged to a triangular connecting rod; the rotating box body is provided with a connecting rod structure under the triangular connecting rod; a lower end of the connecting rod structure is hinged to a rotating head; a top end of the connecting rod structure is hinged to a right side end of the triangular connecting rod; the rotating box body is provided with a connecting rod shaft, and the connecting rod shaft is adapted to a left side end of the triangular connecting rod; the left side end of the triangular connecting rod is hinged on the connecting rod shaft; the rotating box body is further provided with a rotating shaft; a middle part of the rotating head is rotatable on the rotating shaft; the openable lifting lug is provided with a rotating structure mounting plate; a left side of the rotating head is provided with a rotating positioning slot, and the rotating positioning slot is adapted to the rotating structure mounting plate; the rotating positioning slot is assembled on the rotating structure mounting plate by a bolt; the rotating box body is provided with a rotating limiting shaft above the triangular connecting rod; an upper part of the rotating box body is provided with a rotating cylinder fixed shaft; the rotating cylinder fixed shaft is provided with a double-headed nut; and a cylinder barrel part of the rotating cylinder is provided on the double-headed nut.

5. The hydraulic rotary side-swing elevator according to claim 4, wherein a transition plate is provided on a right side of the rotating box body; the transition plate is provided with a set of tubing sockets; an openable sealed box body is provided on a rear side of the elevator body; a bottom edge of the openable sealed box body is connected to a rear side wall edge of the elevator body; a sequence valve is further provided on the rear side wall of the elevator body; the rotating cylinder is connected to the set of tubing sockets through a tubing; the sequence valve is connected to the set of tubing sockets through the tubing; the inner hinge opening and closing cylinder and the outer hinge locking cylinder are connected to the sequence valve through the tubing; left and right side walls of the rotating box body are provided with handles; a front side of the rotating box body is provided with an openable door; the openable door is provided with a door locking pin, and the door locking pin penetrates a rear side wall of the rotating box body; the openable door is further provided with a door locking hole, and the door locking hole is adapted to the door locking pin; and a top end of the door locking pin extending out of the door locking hole is provided with a door locking nut.

6. The hydraulic rotary side-swing elevator according to claim 3, wherein the external fixed structure comprises a snap ring for external connection; the snap ring has a U-shaped opening structure; an opening part of the snap ring is provided with a transverse fixing seat; two ends of the transverse fixing seat are connected to two ends of the opening part of the snap ring; a snap ring shaft is provided on the transverse fixing seat; the snap ring shaft is provided with a set of rotatable support rods; ends of the rotatable support rods away from the snap ring shaft are provided with a side swing shaft; two ends of the side swing shaft are hinged to the side swing cylinders; a top of each of the swing rods is provided with a hook for external connection; a middle part of each of the swing rods is provided with a side swing fixing seat; a cylinder barrel part of each of the side swing cylinders is hinged on the side swing fixing seat; a piston part of each of the side swing cylinders is connected to the side swing shaft; and a set of shaft sleeves are provided on the side swing shaft.

7. The hydraulic rotary side-swing elevator according to claim 2, wherein the external fixed structure comprises a snap ring for external connection; the snap ring has a U-shaped opening structure; an opening part of the snap ring is provided with a transverse fixing seat; two ends of the transverse fixing seat are connected to two ends of the opening part of the snap ring; a snap ring shaft is provided on the transverse fixing seat; the snap ring shaft is provided with a set of rotatable support rods; ends of the set of rotatable support rods away from the snap ring shaft are provided with a side swing shaft; two ends of the side swing shaft are hinged to the side swing cylinders; a top of each of the swing rods is provided with a hook for external connection; a middle part of each of the swing rods is provided with a side swing fixing seat; a cylinder barrel part of each of the side swing cylinders is hinged on the side swing fixing seat; a piston part of each of the side swing cylinders is connected to the side swing shaft; and a set of shaft sleeves are provided on the side swing shaft.

8. The hydraulic rotary side-swing elevator according to claim 2, further comprising a primary bushing provided in the tubing hole and a secondary bushing provided on an inner side wall of the inner hinge, wherein the primary bushing and the secondary bushing define a tubular structure, and the tubular structure is coaxial with the tubing hole; an upper inner side wall of the tubing hole is provided with a primary bushing assembly notch, and the primary bushing assembly notch is adapted to the primary bushing; an upper inner side wall of the inner hinge is provided with a secondary bushing assembly notch, and the secondary bushing assembly notch is adapted to the secondary bushing; a set of bushing positioning holes are provided on an upper end surface of the elevator body and upper ends of the primary bushing and the secondary bushing; the primary bushing and the secondary bushing are provided with bushing limiting pins adapted to the bushing positioning holes; and tops of the limiting pins are respectively provided with a detachable hexagonal slotted nut.

9. The hydraulic rotary side-swing elevator according to claim 1, further comprising a primary bushing provided in the tubing hole and a secondary bushing provided on an inner side wall of the inner hinge, wherein the primary bushing and the secondary bushing define a tubular structure, and the tubular structure is coaxial with the tubing hole; an upper inner side wall of the tubing hole is provided with a primary bushing assembly notch, and the primary bushing assembly notch is adapted to the primary bushing; an upper inner side wall of the inner hinge is provided with a secondary bushing assembly notch, and the secondary bushing assembly notch is adapted to the secondary bushing; a set of bushing positioning holes are provided on an upper end surface of the elevator body and upper ends of the primary bushing and the secondary bushing; the primary bushing and the secondary bushing are provided with bushing limiting pins adapted to the bushing positioning holes; and tops of the limiting pins are respectively provided with a detachable hexagonal slotted nut.

10. The hydraulic rotary side-swing elevator according to claim 9, further comprising a tubing string sensing structure; the tubing string sensing structure comprises a tubing string sensing proximity switch, a tubing string sensing block, a tubing string sensing pin and a tubing string sensing compression spring, wherein the primary bushing is provided with a tubing string sensing notch; the elevator body is provided with a tubing string sensing track through hole, and the tubing string sensing track through hole penetrates a side wall of the elevator body to communicate with the tubing hole; an outer side wall of the elevator body is provided with a tubing string sensing fixing seat; the tubing string sensing proximity switch is vertically provided on the tubing string sensing fixing seat; the tubing string sensing pin is movable in left and right directions in the tubing string sensing track through hole; the tubing string sensing compression spring is provided in the tubing string sensing track through hole; a left side end of the tubing string sensing compression spring is connected to the tubing string sensing pin, and a right side end of the tubing string sensing compression spring is connected to a right inner side wall of the tubing string sensing track through hole; a tubing string sensing fixed shaft is provided in the tubing string sensing notch; the tubing string sensing block is rotatably provided on the tubing string sensing fixed shaft; left and right ends of the tubing string sensing pin extend out of the tubing string sensing track through hole; and a left end part of the tubing string sensing pin is connected to a right lower side wall of the tubing string sensing block, and a right end part of the tubing string sensing pin is located under the tubing string sensing proximity switch.

11. The hydraulic rotary side-swing elevator according to claim 10, wherein further comprising a tubing string downward pressure sensing structure, wherein the tubing string downward pressure sensing structure comprises a tubing string coupling sensing pin, a tubing string downward pressure sensing proximity switch, a tubing string downward pressure sensing block, a tubing string downward pressure sensing pin and a tubing string downward pressure sensing compression spring; the primary bushing is provided with a tubing string downward pressure sensing notch above the tubing string sensing notch; the elevator body is provided with a tubing string downward pressure sensing track through hole, and the tubing string downward pressure sensing track through hole penetrates the side wall of the elevator body to communicate with the tubing hole; the outer side wall of the elevator body is provided with a tubing string downward pressure sensing fixing seat; the tubing string downward pressure sensing proximity switch is provided on the tubing string downward pressure sensing fixing seat; the tubing string downward pressure sensing pin is movable in left and right directions in the tubing string downward pressure sensing track through hole; the tubing string downward pressure sensing compression spring is provided in the tubing string downward pressure sensing track through hole; two ends of the tubing string downward pressure sensing compression spring respectively abut against the tubing string downward pressure sensing pin and an inner wall of the tubing string downward pressure sensing track through hole; a tubing string downward pressure sensing fixed shaft is provided in the tubing string downward pressure sensing notch; the tubing string downward pressure sensing block is rotatably provided on the tubing string downward pressure sensing fixed shaft; left and right ends of the tubing string downward pressure sensing pin extend out of the tubing string downward pressure sensing track through hole; a left end part of the tubing string downward pressure sensing pin is connected to a right lower side wall of the tubing string downward pressure sensing block, and a right end part of the tubing string downward pressure sensing pin is adapted to the tubing string downward pressure sensing proximity switch; an upper end of the primary bushing is provided with a tubing string downward pressure sensing through hole, and the tubing string downward pressure sensing through hole is communicated with the tubing string downward pressure sensing notch; the tubing string coupling sensing pin is raised and lowered in the tubing string downward pressure sensing through hole; a top end of the tubing string coupling sensing pin extends out of the tubing string downward pressure sensing through hole and is adapted to a tubing string; an upper end of the tubing string coupling sensing pin extends out of an upper end surface of the primary bushing from the tubing string downward pressure sensing through hole; and a bottom of the tubing string coupling sensing pin is connected to an upper end surface of the tubing string downward pressure sensing block.

12. The hydraulic rotary side-swing elevator according to claim 9, wherein further comprising a tubing string downward pressure sensing structure, wherein the tubing string downward pressure sensing structure comprises a tubing string coupling sensing pin, a tubing string downward pressure sensing proximity switch, a tubing string downward pressure sensing block, a tubing string downward pressure sensing pin and a tubing string downward pressure sensing compression spring; the primary bushing is provided with a tubing string downward pressure sensing notch above the tubing string sensing notch; the elevator body is provided with a tubing string downward pressure sensing track through hole, and the tubing string downward pressure sensing track through hole penetrates the side wall of the elevator body to communicate with the tubing hole; the outer side wall of the elevator body is provided with a tubing string downward pressure sensing fixing seat; the tubing string downward pressure sensing proximity switch is provided on the tubing string downward pressure sensing fixing seat; the tubing string downward pressure sensing pin is movable in left and right directions in the tubing string downward pressure sensing track through hole; the tubing string downward pressure sensing compression spring is provided in the tubing string downward pressure sensing track through hole; two ends of the tubing string downward pressure sensing compression spring respectively abut against the tubing string downward pressure sensing pin and an inner wall of the tubing string downward pressure sensing track through hole; a tubing string downward pressure sensing fixed shaft is provided in the tubing string downward pressure sensing notch; the tubing string downward pressure sensing block is rotatably provided on the tubing string downward pressure sensing fixed shaft; left and right ends of the tubing string downward pressure sensing pin extend out of the tubing string downward pressure sensing track through hole; a left end part of the tubing string downward pressure sensing pin is connected to a right lower side wall of the tubing string downward pressure sensing block, and a right end part of the tubing string downward pressure sensing pin is adapted to the tubing string downward pressure sensing proximity switch; an upper end of the primary bushing is provided with a tubing string downward pressure sensing through hole, and the tubing string downward pressure sensing through hole is communicated with the tubing string downward pressure sensing notch; the tubing string coupling sensing pin is raised and lowered in the tubing string downward pressure sensing through hole; a top end of the tubing string coupling sensing pin extends out of the tubing string downward pressure sensing through hole and is adapted to a tubing string; an upper end of the tubing string coupling sensing pin extends out of an upper end surface of the primary bushing from the tubing string downward pressure sensing through hole; and a bottom of the tubing string coupling sensing pin is connected to an upper end surface of the tubing string downward pressure sensing block.

13. The hydraulic rotary side-swing elevator according to claim 9, further comprising a locking structure, wherein the locking structure comprises a locking pressure pin, a locking strut, a locking pin and a locking compression spring; the secondary bushing is movable in up and down directions in the secondary bushing assembly notch; an upper end surface of the secondary bushing is movable in up and down directions between the bushing limiting pin and an upper end surface of the elevator body; the inner hinge is provided therein with a locking track passage under the secondary bushing notch; the locking track passage is L-shaped, with two ends respectively communicated with a bottom end surface of the secondary bushing assembly notch and an outer side wall of the inner hinge; the locking pressure pin is raised and lowered in the locking track passage; a top of the locking pressure pin extends out of the bottom end surface of the secondary bushing assembly notch and is connected to a bottom surface of the secondary bushing; the outer side wall of the inner hinge is provided with a locking pin fixing seat; a strut pin is provided in the locking track passage; a middle part of the locking strut is rotatably provided on the strut pin; a first end of the locking strut extends out of the locking track passage and is hinged to a bottom of the locking pin, and a second end of the locking strut located in the locking track passage is connected to a lower end of the locking pressure pin; the locking pin fixing seat is provided with a locking pin guide hole adapted to the locking pin; a top of the locking pin is provided in the locking pin guide hole; the locking compression spring is sleeved on the locking pin; a top of the locking compression spring abuts against a lower end surface of the locking pin fixing seat; an inner side wall of the outer hinge is provided with a locking hole, and the locking hole is adapted to the locking pin; a side wall of the inner hinge is provided with a bushing limiting hole; a bushing limiting shaft is provided in the bushing limiting hole; a side wall of the secondary bushing is provided with a bushing limiting opening; and the bushing limiting shaft is located in the bushing limiting opening.

* * * * *